United States Patent [19]

Lewis

[11] 4,213,315

[45] Jul. 22, 1980

[54] KEY ACTUATED SECURITY ENTRY SYSTEM

[76] Inventor: Bernard R. Lewis, 2049 S. Ocean Dr., Hallandale, Fla. 33009

[21] Appl. No.: 887,472

[22] Filed: Mar. 17, 1978

[51] Int. Cl.[2] ..... E05B 65/00

[52] U.S. Cl. ..... 70/94; 70/421; 292/DIG. 15

[58] Field of Search ..... 70/94, 387, 419, 421, 70/379 R, 379 A, 416; 292/DIG. 15, 338

[56] References Cited

U.S. PATENT DOCUMENTS

| | | | |
|---|---|---|---|
| 963,527 | 7/1910 | Dessauer et al. | 70/94 |
| 3,670,540 | 6/1972 | Fernandez | 70/421 |
| 4,068,510 | 1/1978 | Neary | 70/379 R |

*Primary Examiner*—Kenneth Dorner
*Attorney, Agent, or Firm*—Barry L. Haley

[57] ABSTRACT

A key-actuated security entry system for an inwardly opening door to prevent unauthorized opening of the door. The system includes a pivotal, floor-engaging doorstop mounted on the door inside surface near its base, a key-actuated tumbler lock mounted through the door, preferably below the doorknob handle, the lock including a rotatable shaft protruding from the inside lock housing surface, and a cable connected to the shaft and the pivotal doorstop. The shaft includes a rachet lock requiring a proper key to disengage the shaft from the lock housing to permit shaft rotation by the key. Shaft rotation lifts the doorstop permitting entry through the doorway.

1 Claim, 5 Drawing Figures

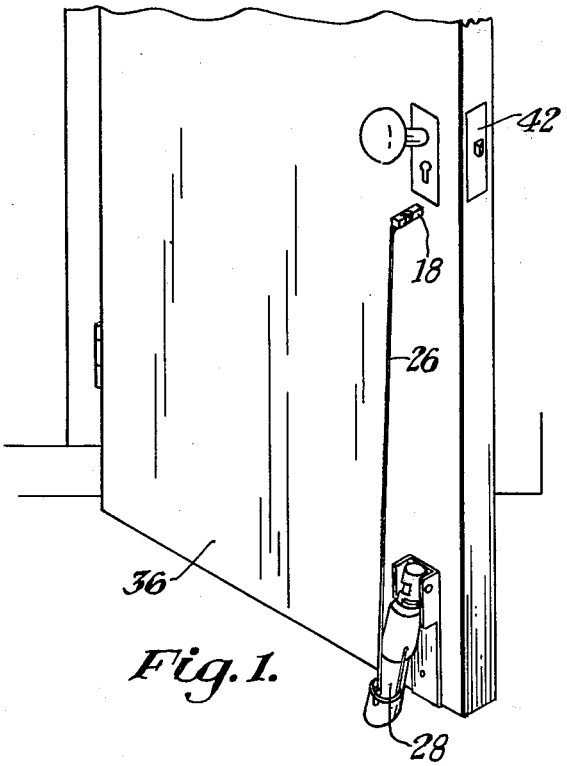
Fig. 1.
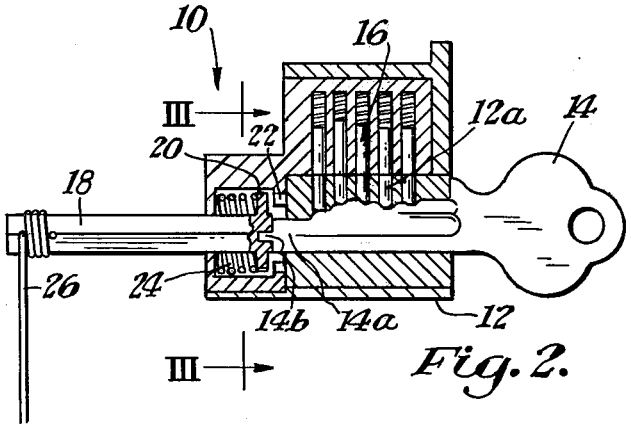
Fig. 2.
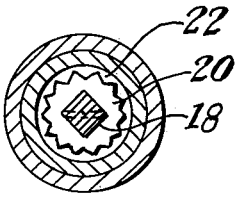
Fig. 3.
Fig. 4.
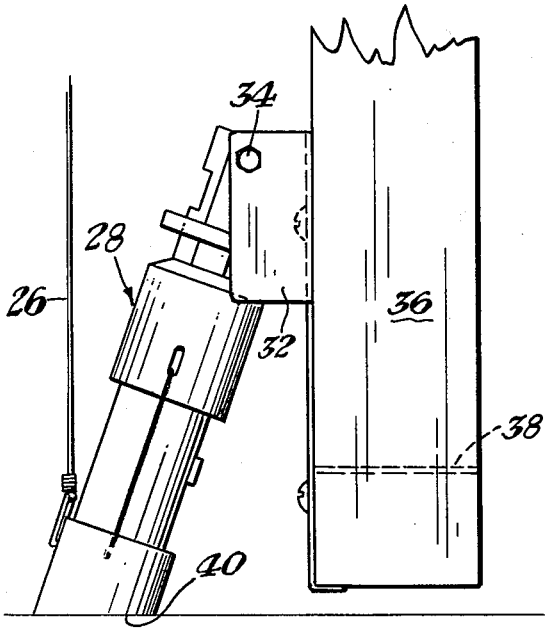
Fig. 5.
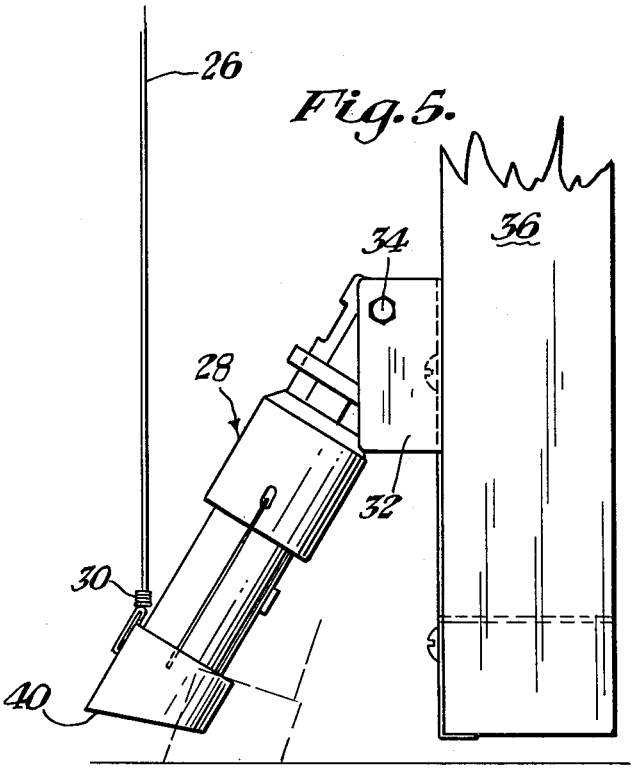

KEY ACTUATED SECURITY ENTRY SYSTEM

BACKGROUND OF THE INVENTION

This invention relates generally to a security entry system to prevent unauthorized entry through an inwardly opening door, and specifically to a key-operated tumbler lock having a shaft and cable used to raise (or lower) a doorstop mounted on an inwardly swinging door, preventing opening of the door whenever the doorstop is down.

It is well known to employ a conventional key actuated tumbler type lock in conjunction with a bolt to prevent unauthorized access into a room through an inwardly opening door. In fact, many devices have been suggested and tried to achieve a burglar-proof entry system for doors. One of the problems with the conventional, key operated tumbler locks is that the lock is subject to "picking" by someone of skill that results in opening the lock and moving the bolt without the proper key. Another problem, is that often the lock bolt itself can be moved to an unlocked position by a thin plastic sheet thrust into the door jamb bolt area or by prying the door jamb with a crowbar or the like, in either case allowing circumvention of the lock. Even a deadbolt lock bolt can be pryed open with a sufficient tool to allow unauthorized entry through a door.

The present invention overcomes the deficiencies of the prior art by providing a key-actuated doorstop security system that prevents unauthorized opening of a door, "picking" of the doorstop actuating lock or any unauthorized entry through an inwardly opening door which could be caused by prying open the door bolt from the jamb. With the use of the present invention, a doorstop engages the floor surface at all times when the door is to remain inaccessable, thus keeping the door closed regardless of conditions of the door bolt or jamb. Only the proper key in conjunction with the tumbler lock provided will also access through the door, since the proper key is the only means for lifting the doorstop from the door outside.

BRIEF DESCRIPTION OF THE INVENTION

A security system to prevent unauthorized entry through an inwardly opening door comprising a doorstop pivotally connected at one end near the base inside the door, the doorstop free end engageable with the floor beneath, a key-actuated tumbler lock mounted through the door, said lock having a rotatable shaft extending from the inside lock housing, a cable connected at one end to the doorstop and to the rotatable shaft. Insertion of the proper key permits rotation of the shaft to raise (or lower) the doorstop. The tumbler lock includes a conventional cylindrically shaped tumbler core that receives a proper key in conjunction with a plurality of conventional tumblers that are aligned by the key bits to effect core rotation. The shaft end has a plurality of rachet teeth peripherally on an annular disc that interlocks with similar teeth on the inside an an annular ring fixed to the lock housing. The shaft is moveable longitudinally by the proper key. The shaft annular disc is spring-loaded within the housing ring teeth to prevent rotation of the shaft (unless the disc and ring are separated) by insertion of the proper key, which has an extended tip that moves the shaft longitudinally against the spring, thereby disengaging the shaft disc teeth from the lock housing ring teeth. A slot is provided in the shaft disc that receives the end tip of the key to interlock the key tip end in the shaft disc slot.

Thus, two conditions must be satisfied to rotate the shaft in order to raise the doorstop. The tumblers must be aligned to rotate the core and the shaft must be disengaged from the lock housing. This prevents "picking" of the lock.

In order to operate the security system disclosed herein, a typical situation is discussed. For example, when leaving a dwelling or room and it is desired to prevent unauthorized access, the cable may be unwound by manually grasping the cable and rotating or unwinding the cable from the shaft while on the inside to pay out enough cable such that the doorstop free end is flush against the floor as the door is closed. The doorstop will then be in its proper locking position. Because of the angle of the doorstop against the floor in the down (locked) position, regardless of what happens to the bolt of the door, it will be impossible to open the door against the doorstop. A person with the proper key may free the security system in order to gain access into the room by merely inserting the proper key into the tumbler lock and rotating the key two rotations in the proper direction, which causes the cable to wrap about the shaft, lifting the free end of the doorstop slightly above the floor surface to allow the door to swing freely, disengaging the doorstop from the floor. The shaft diameter is selected to allow sufficient lifting by two rotations.

It is an object of this invention to provide an improved security system for an inwardly opening floor that prevents unauthorized entry.

It is another object of this invention to provide a doorstop which is used to prevent unauthorized entry through a door that is actuated by a key and tumbler-like lock mechanism.

And yet, still another object of this invention is to provide a security system that includes an antipick lock and door security to prevent lock "picking" or "jimmying" of a bolt.

In accordance with these and other objects which will be apparent hereinafter, the instant invention will now be described with particular reference to the accompanying drawings.

BRIEF DESCRIPTION OF THE DRAWINGS

FIG. 1 shows a side elevational view partially in cross-section showing the tumbler lock and cable shaft mechanism forming part of the instant invention.

FIG. 2 shows an end elevational view partially in cross-section.

FIG. 3 shows the instant invention in a perspective view as mounted on an inwardly opening door.

FIG. 4 shows a side elevational view of the instant invention with the doorstop in the locking position to prevent movement of the door in the inward direction.

FIG. 5 shows the instant invention having the doorstop in the raised position which allows the door to swing freely.

PREFERRED EMBODIMENT OF THE INVENTION

Referring now to FIGS. 1 and 2, the cable actuating lock is shown generally at 10 comprised of a tumbler lock housing 12 rigidly secured in a door, which includes a plurality of conventional tumblers 16 mounted therein and a key which is received into the lock core **12*a* within housing 12 which allows the core 12*a* to be rotated when the tumblers are properly aligned by the key bits. The key includes an extended end tip 14***a* which engages a slot 14*b* in shaft 18 allowing for the interlocking between key 14 and shaft 18 to allow rotation of the shaft 18. The shaft 18 includes an annular disc 20 having rachet teeth which interlock with an annular ring 22 having rachet teeth inwardly which is fixed to the lock housing 12. The purpose of the interlocking disc 20 and ring 22 is that when a key is not inserted into the lock, spring 24 locks the shaft by the teeth to the lock housing, preventing rotation of the shaft. Thus, the shaft cannot rotate unless it is separated from the lock housing (against the spring tension) by the end of the key having an extended tip for moving the shaft longitudinally. The cable 26 is wound and connected to the shaft 18. The tumbler portion of the key actuated lock is conventional.

FIG. 3 shows the interlocking of disc 20 with the ring 22 such that the shaft cannot move when the teeth are intermeshed.

FIG. 1 shows the device mounted on an inwardly opening door 36 having a conventional door bolt mechanism 42. The lock and the protruding shaft 18 are mounted through the door below the door handle to prevent interference between the cable and the door handle. The cable 26 is wrapped around a portion of the shaft 18 and is connected at one end to a suitable doorstop 28, pivotally mounted near the base of door 36.

FIG. 4 shows a doorstop 28 pivotally mounted by pin 34 on a bracket plate 32 fixed to a door 36. In the posture shown in FIG. 4, the bottom free end 40 of the doorstop 28 is shown engaged with the horizontal floor surface. This represents the locking position for the security system to prevent movement of the door in the direction of the doorstop (inwardly).

FIG. 5 shows the device in the position to permit free movement of door 36 by raising slightly the free end 40 of the doorstop above the floor to permit freedom of movement of the door.

Additionally, as a safety feature should the key become lost, a minute, imperceivable hole 38 may be placed through the door in alignment with the doorstop to allow a very thin, elongated tool to be received through the door, allowing the doorstop to be slightly lifted to permit movement of the door. The aperature would be small enought to be undectable to someone who is not aware of its presence.

In operation, the system as shown in FIG. 1, would be manually unwrapped to drop the doorstop into position just prior to leaving the room. Once the door is closed, it will be secured by the doorstop being down. When it is desirous to open the door, the proper key is inserted which presses the shaft and spring tension releasing the shaft, allowing it to be rotated by actuation of the key. The tumbler lock may be constructed such that the key can be removed from the lock on every second rotation. The shaft size will be selected to allow for two rotations of the shaft to raise the doorstop sufficiently above the floor to disengage it.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A security system to prevent unauthorized entry to an inwardly opening door, comprising:

a doorstop pivotally mounted to the inwardly opening side of said door, said doorstop moveable from a first position above the floor surface to a second position engaged with the floor surface;

a cable; and a key-actuated tumbler lock having a housing, a tumbler core, and a plurality of tumblers, said lock mounted through said door, said key-actuated tumbler lock having a shaft having a first position moveable and free of said lock housing and a second position locked to the lock housing, said cable connected between said shaft and said doorstop whereby rotation of the shaft by a proper key effects lifting of the doorstop;

said tumbler core movable by insertion of the proper key with key bits for aligning the tumblers to effect rotation of the core;

said lock housing having a ring having a plurality of teeth disposed inwardly fixed to the housing;

said shaft including a disc having a plurality of rachet teeth disposed around its periphery, said shaft being mounted so that said disc engages said ring of said housing in said second position;

a spring connected to said housing and said shaft disc for holding said shaft disc within said ring teeth, said shaft being aligned with the tumbler core and movable longitudinally against the spring tension whenever a proper key is inserted therein;

said shaft disc includes a recess having a shape to permit entry of a key tip to effect rotation of said shaft when the shaft is separated from the housing ring.

* * * * *